United States Patent [19]

Greenawalt

[11] Patent Number: 4,987,804

[45] Date of Patent: Jan. 29, 1991

[54] STRAP WRENCH

[75] Inventor: Steven C. Greenawalt, Reading, Pa.

[73] Assignee: Easco Hand Tools, Inc., Lancaster, Pa.

[21] Appl. No.: 524,586

[22] Filed: May 17, 1990

[51] Int. Cl.[5] ..... B25B 13/52

[52] U.S. Cl. ..... 81/64; 81/3.43

[58] Field of Search ..... 81/64, 65.2, 3.43

[56] References Cited

U.S. PATENT DOCUMENTS

| | | | |
|---|---|---|---|
| 1,383,123 | 6/1921 | Jones | 81/64 |
| 1,479,902 | 1/1924 | Ellison | 81/64 |
| 2,004,830 | 6/1935 | Rector | 81/64 |
| 2,656,749 | 10/1953 | Johnson | 81/64 |
| 3,728,916 | 4/1973 | Brantley | 81/64 |
| 3,962,936 | 6/1976 | Lewis | 81/64 |
| 4,506,568 | 3/1985 | Aamodt | 81/64 |
| 4,750,389 | 6/1988 | Shuster | 81/64 |

*Primary Examiner*—James G. Smith
*Attorney, Agent, or Firm*—Leonard Bloom

[57] ABSTRACT

A strap wrench for engaging a workpiece. The strap wrench includes a housing having a first side, a second side, a top and a bottom. A cam means is pivotally mounted in the housing. The cam means has a first end and a second end and, when pivoted, the first end and the second end of the cam means approach the respective sides of the housing. A flexible strap means having a first end, a second end and an intermediate portion is provided. The ends of the strap means are received in the housing, passing through the housing to form a loop in the intermediate portion of the strap means. The cam means may be pivoted to engage the strap means between the respective ends of the cam means and the respective sides of the housing such that the loop in the strap is securely about the workpiece. An opening through the cam means communicates with openings in the top and in the bottom of the housing. A wrenching means may be inserted into opening in the cam means for pivoting the cam means and for moving the workpiece concomitantly with the strap wrench. The cam means further has a bore extending longitudinally from the second end towards the first end of the cam means. A tool may be received in the bore in the cam means to pivot the cam means and to move the workpiece. The cam means may also have grooves thereon to cooperate with grooves on the strap means.

15 Claims, 8 Drawing Sheets

STRAP WRENCH

FIELD OF THE INVENTION

The present invention relates to a strap wrench for engaging a workpiece and in particular to a strap wrench having a camming assembly for adjusting the tightness of the strap to facilitate turning of a workpiece such as a pipe or pulley.

BACKGROUND OF THE INVENTION

There is frequently a need to be able to turn a workpiece such as a pipe or a pulley for repairs, replacement and other services. Standard wrenches do not fit these workpieces and often the workpiece is so situated that access to the workpiece is very difficult. In these situations a flexible strap and a means for tightening the strap around the workpiece is essential.

A specialized form of a strap wrench is an oil filter wrench which are disclosed in U.S. Letters Patent Nos. 3,465,622 issued to Winans, 4,114,481 issued to Kowalczyk and 4,506,568 issued to Aamodt. Both Winans and Kowalczyk disclose a clamping band with a center opening and the ends of the bands connected to pivot points. While being useful in removing oil filters, these devices have pivoting points which are subject to damage and further are substantially closed loops which can be used only with workpieces which are accessible from one end so that the loop can be slid over the workpiece. Aamodt discloses the ends of a strap passing through a longitudinal slot in each part of a two part cylindrical holder and overcomes the problems presented by Winans and Kowalczyk. However, the device of Aamodt comprises two separate holder pieces which must be placed one within the other. This is not easily accomplished in restricted work space. Further, loss or misplacement of one of the holder pieces renders the device useless.

A chain wrench is disclosed in U.S. Letters Patent No. 2,353,642 issued to Buice. U.S. Letters Patent No. 4,160,394 issued to Crumpacker discloses a wrench having an elongated handle received on a bracket and a flexible loop connected to the handle. Adjustment means is provided by manipulation of a sleeve surrounding a rigid inner handle section. U.S. Letters Patent No. 3,373,637 issued to Behnke discloses a portable rotary drive unit having a rotary drive socket with a peripheral ring gear driven by a motor. These comparatively complex devices are expensive, relatively heavy, and are not conducive to work in confined spaces. U.S. Letters Patent No. 1,911,815 issued to Deringer et al disclose a strap wrench in which one end of the strap is attached to an elongated handle and the other end of the strap passes through several inclines and slots in the handle to secure the strap. Operation of this device is also restricted when working in a confined space. U.S. Letters Patent No. 3,962,936 issued to Lewis discloses a strap wrench having loose ends mounted in a cylinder having a slot passing diametrically through the center. The slot receives both ends of the strap and the cylinder is rotated, wrapping the strap around the cylinder to produce a tightening action. Although this device has been known since 1976, it has not had public acceptance and the applicant is unaware of any of these devices being available on the open market.

U.S. Letters Patent No. 701,489 issued to Love discloses a pipe wrench wherein one end of the strap is attached to a handle, the strap passing through a slot in the handle, around the workpiece over a nose on the handle, and back through the same slot in the handle. U.S. Letters Patent No. 1,478,110 issued to Ellison also discloses a handle having a nose thereon over which the strap passes as the strap enwraps the workpiece. The handle further has two laterally extending arms and a bridge portion in which the strap is received. U.S. Letters Patent No. 2,186,430 issued to Richter discloses a household implement having a handle with a slot therein. One end of a strap is attached to the handle, the strap passing through the slot, around the workpiece and returning through the slot. U.S. Letters Patent No. 2,458,393 issued to Loudfoot discloses a handle having three aligned openings and a frictional cord having both ends attached to the handle. The frictional cord is threaded through openings to form a loop to engage the workpiece. U.S. Letters Patent No. 2,995,965 issued to Hockney discloses a strap having one end folded about a pin and secured to the body of the strap. The other end of the strap is looped about the workpiece and threaded through an elongated slot in a cylindrical retainer body. The retainer body has ends which may engage a handle member to rotate the retainer body to secure the strap about the workpiece.

None of the above have provided a simple, easy to operate, inexpensive lightweight strap wrench which can be used in confined spaces where access is difficult and a need for such a wrench exists.

SUMMARY OF THE INVENTION

A principal object of the present invention is to provide a strap wrench which is easy to operate and can be used easily in confined spaces.

It is another object of the present invention to provide a strap wrench in which a strap means may be placed about a workpiece and the ends of the strap means inserted in a housing, the housing having means for tightening the strap means about a workpiece so that the workpiece may be turned.

It is still another object of the present invention to provide a strap wrench having a camming means for securing the strap means to prevent slippage of the strap means.

It is yet another object of the present invention to provide means to connect a wrenching means to the cam means such that the strap wrench may be secured about a workpiece and the workpiece may be easily moved.

In accordance with the teachings of the present invention, there is herein disclosed a strap wrench for engaging a workpiece which includes a housing having a top, a bottom, a first side, a second opposing side, an open front end and an open back end. A cam means is mounted within the housing. The cam means has a first end, a second end and a center portion. The cam means is disposed in the housing between the top of the housing and the bottom of the housing such that the first end of the cam means is oriented toward the front end of the housing and the second end of the cam means is oriented toward the back side of the housing. The center portion of the cam means is attached to the housing for pivotal movement therein such that the first end and the second end of the cam means are spaced apart from the respective sides of the housing. When the cam means is pivotally moved, the ends of the cam means approach the respective sides of the housing. A flexible strap means is provided having a first end, a second end and an intermediate portion therebetween. The first end of the strap means is removably disposed through the housing in the space between the cam means and the first side of the housing. The second end of the strap means is removably disposed in the housing in the space between the cam means and the second side of the housing. In this manner, the respective ends of the strap means extend outwardly from the back side of the housing and a flexible loop is formed in the intermediate portion of the flexible strap means. The loop extends outwardly from the front side of the housing, said loop being formed and secured about the workpiece. Means are provided for pivotally moving the cam means within the housing such that the first end of the cam means and the second end of the cam means may engage the strap means between the respective ends of the cam means and the respective sides of the housing. The strap means is locked therebetween to prevent movement of the strap means. When the strap means is so locked, further movement of the housing in a rotational direction produces concomitant movement in the workpiece about which the strap means is looped.

Preferably the strap means has a plurality of grooves therein and the cam means has a corresponding plurality of grooves cooperating with the grooves on the strap means. Also, the sides of the cam means are arcuate.

In a preferred embodiment the cam means has an opening therein and a wrench means may be received in the opening. The wrench means may be a ratchet wrench and it may be a pry bar.

These and other objects of the present invention will become apparent from a reading of the following specification, taken in conjunction with the enclosed drawings.

DESCRIPTION OF THE PREFERRED EMBODIMENTS

Figure 1:
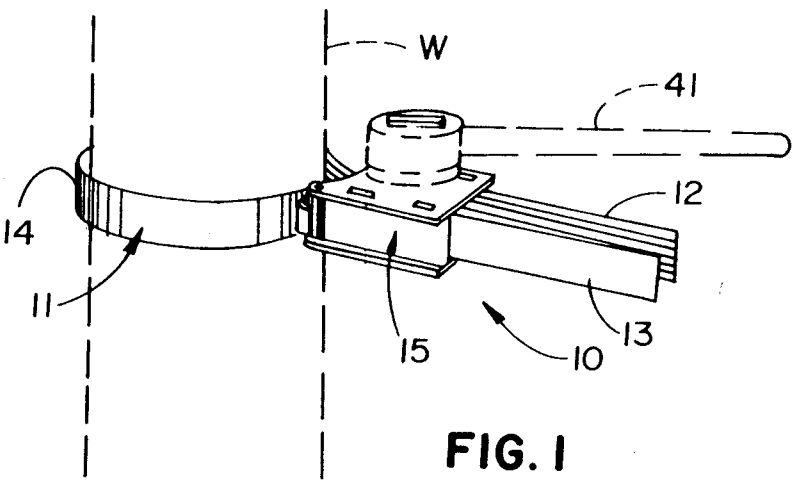
FIG. 1 is a perspective view of the device of the present invention during use thereof on a six inch diameter pipe.
Figure 2:
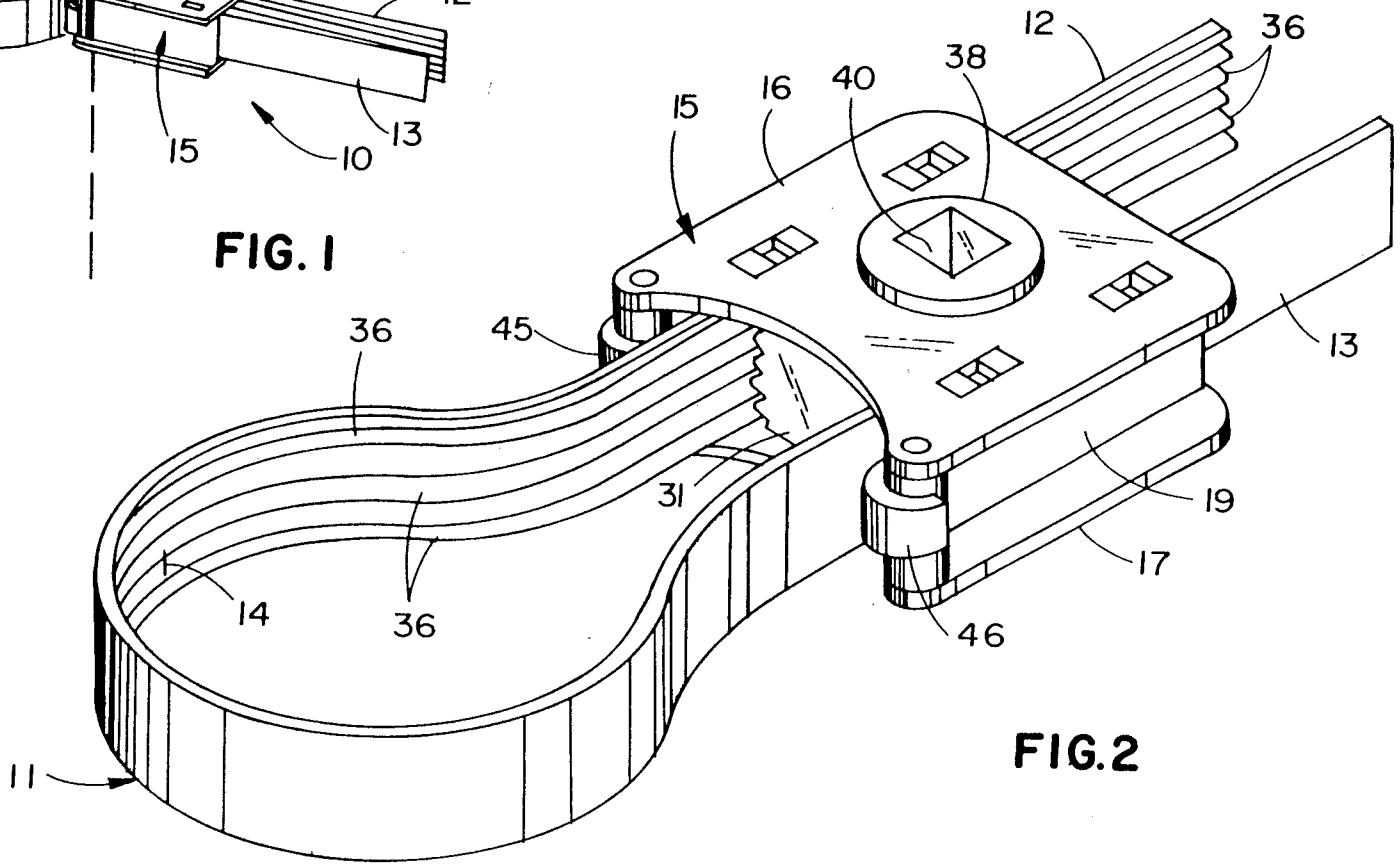
FIG. 2 is a perspective view of the device of the present invention.
Figure 3:
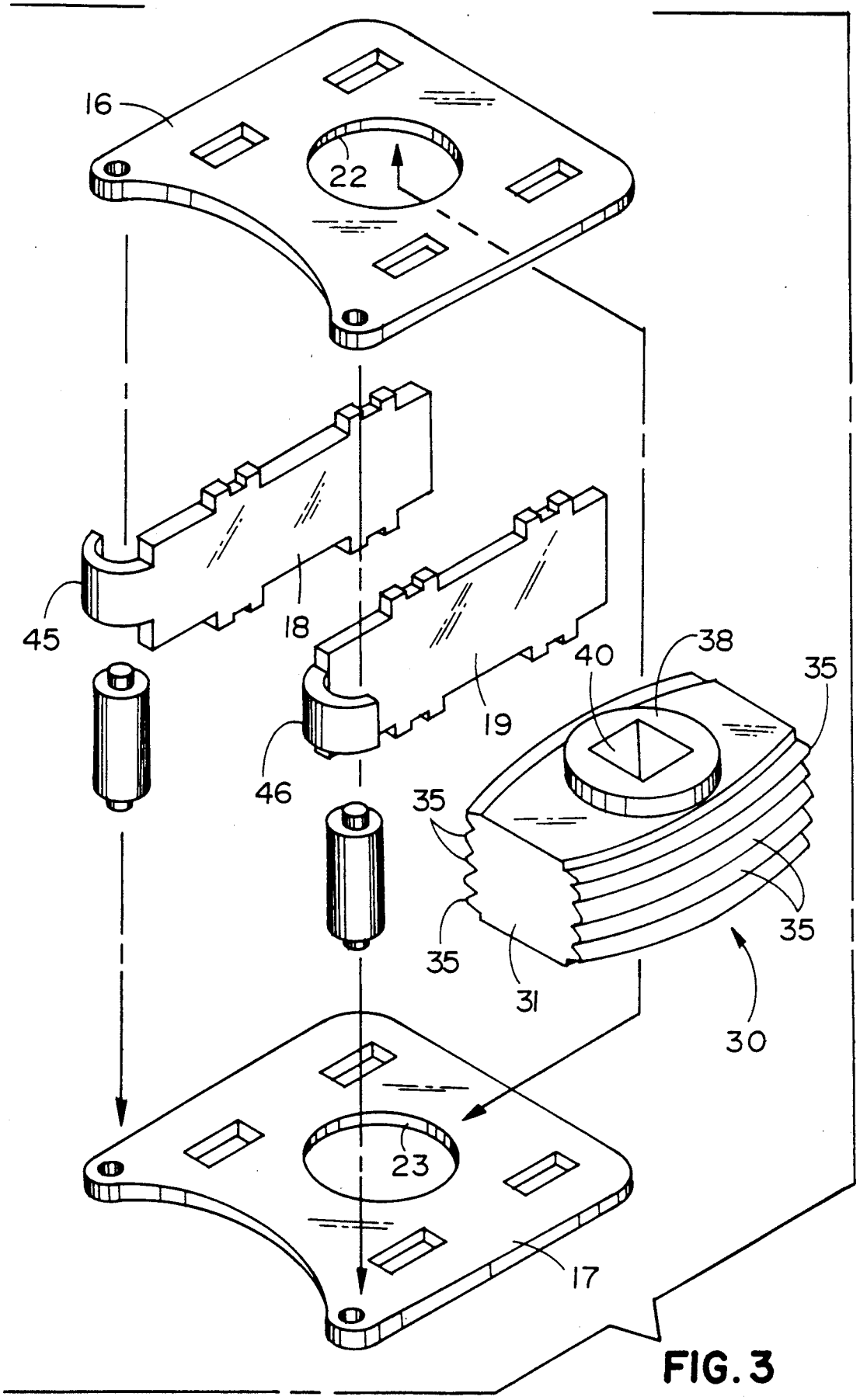
FIG. 3 is an exploded perspective view of the housing and the cam means of the present invention.

Referring now to the drawings, FIGS. 1–3 show the strap wrench 10 of the present invention and its use in a typical application. FIGS. 2 and 3 show the elements of the strap wrench 10. The flexible strap means 11 has a first end 12, a second end 13 and an intermediate portion 14 therebetween. The housing 15 includes a top 16 and a bottom 17, a first side 18 and a second side 19. The front end of the housing and the back end of the housing are open. The ends 20, 21 of the respective sides 18, 19 which are directed toward the intermediate portion 14 of the strap means 11, are curved as will be described later. Both the top 16 and the bottom 17 of the housing 15 have respective openings 22, 23 therein. Disposed between, the top 16 and bottom 17 and the sides 18, 19 of the housing 15, is a cam means 30. The cam means 20 has a first end 31 oriented toward the front end of the housing 15 and a second end 32, oriented toward the back end of the housing 15. The center portion of the cam means is attached to the top 16 and the bottom 17 of the housing 15 for pivotal movement of the cam means 30 therebetween. Other means of pivotally mounting the cam means 30 with the housing 15 may be provided. The first end 31 and the second end 32 of the cam means 30 are spaced apart from the respective sides 18, 19 of the housing 15. When the cam means 30 is pivotally moved, the ends 31, 32 of the cam means 30 approach the respective sides 18, 19 of the housing 15. The term cam means has been used herein as applied to the member 30 although the member may be considered as a wedge or locking means.

Figure 4B:
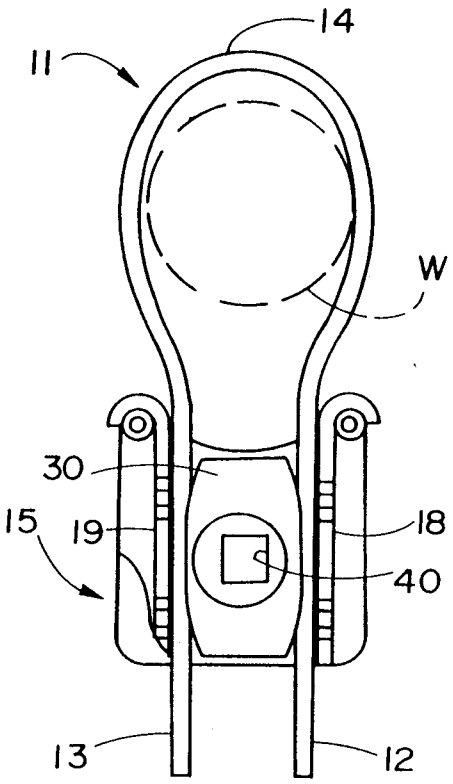
FIGS. 4A–4F are top plan views of the device of the present invention having a portion thereof broken away therefrom to reveal the pivotal movement of the cam means the engagement of the strap means about the workpiece and the movement of the workpiece together with the device.
Figure 4A:
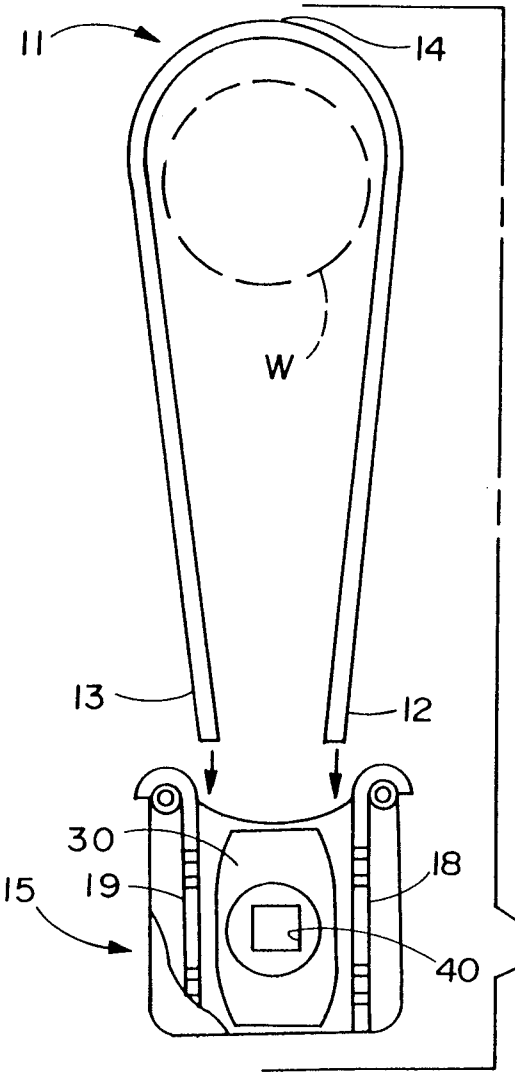
Figure 4D:
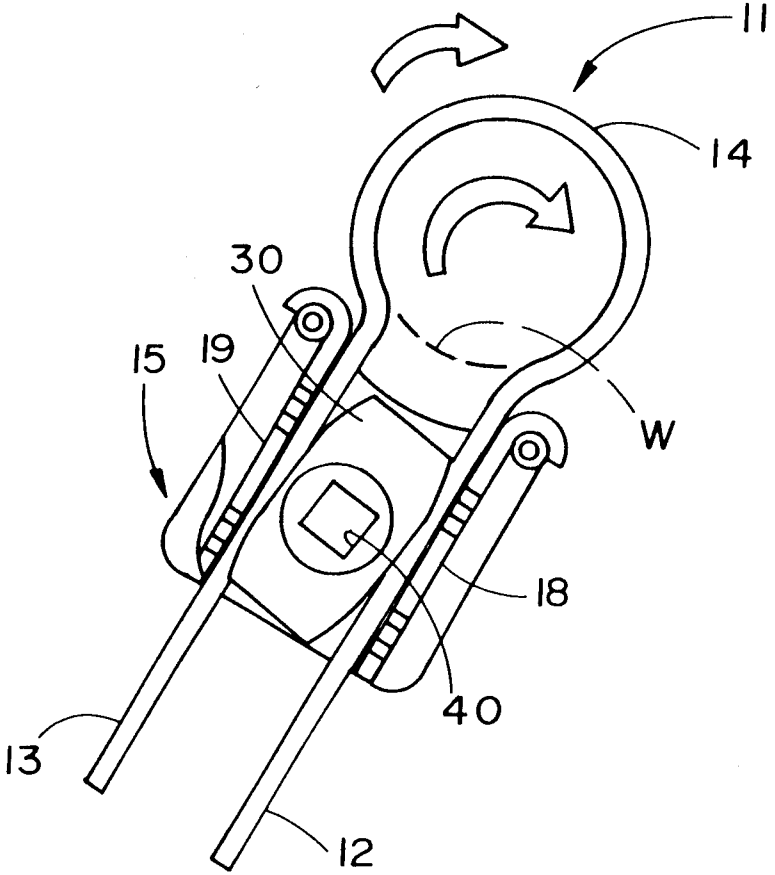
Figure 4C:
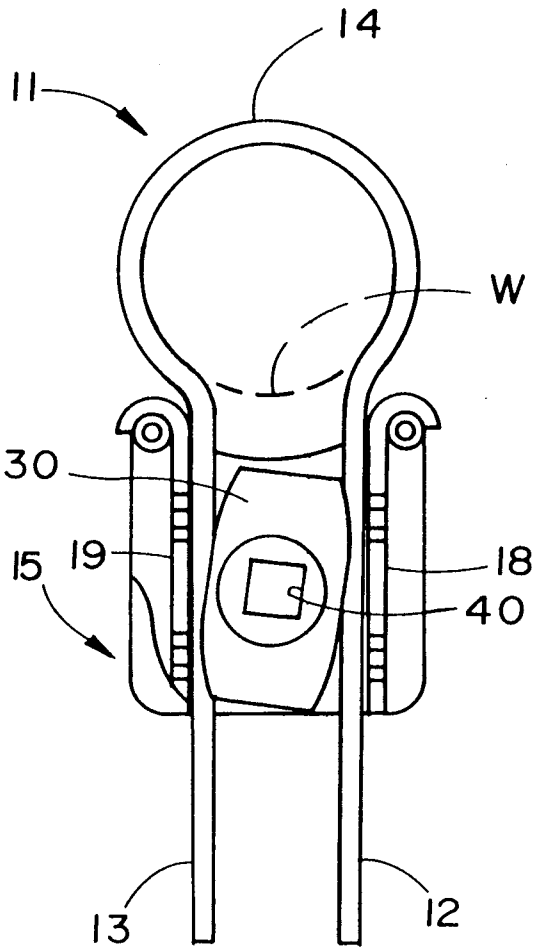
Figure 4F:
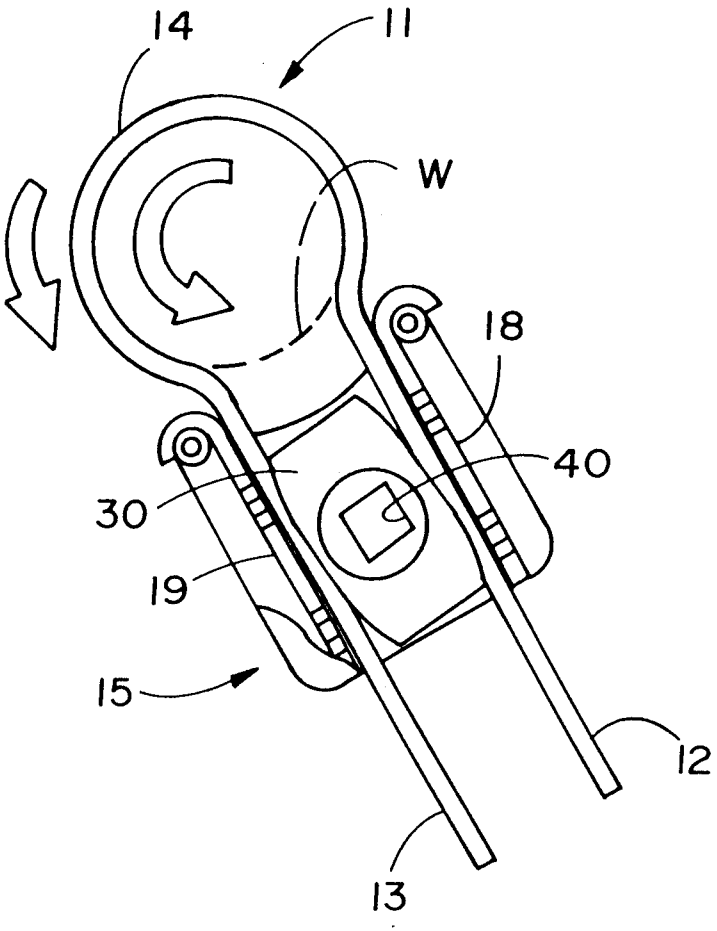
Figure 4E:
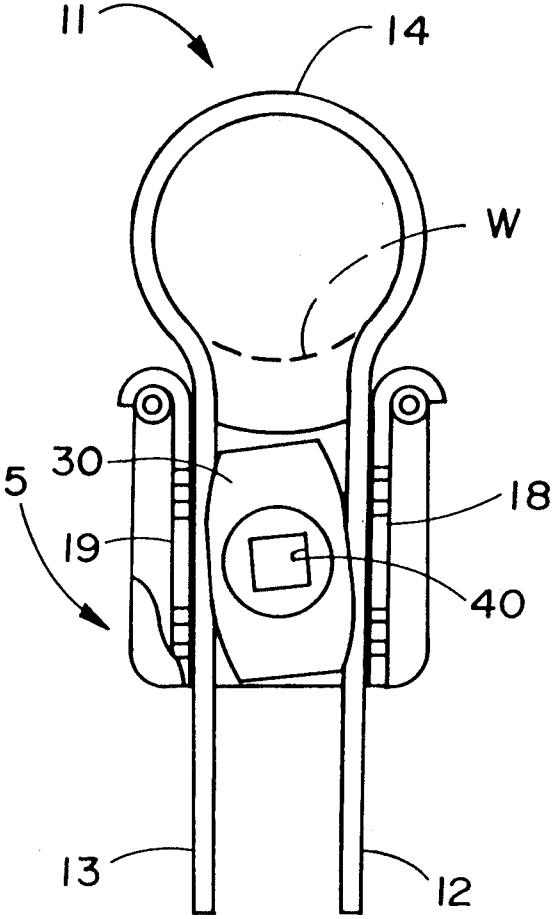
Figure 5A:
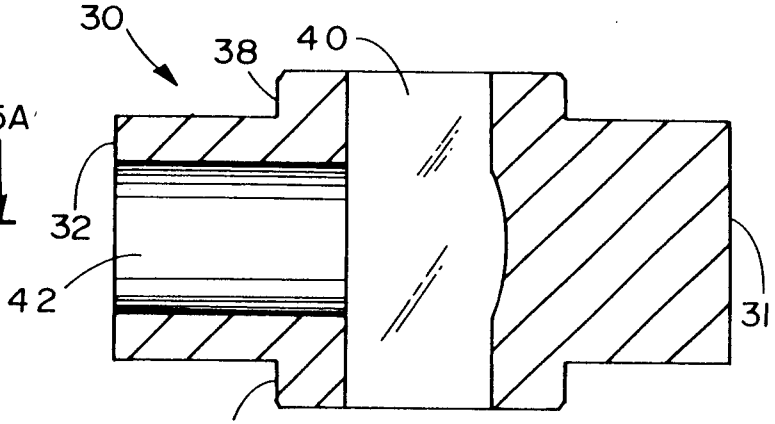
FIG. 5A is a sectional view taken along the lines 5A—5A of FIG. 5.

The operation of the strap wrench 10 is shown in the sequence of FIGS. 4A–4F. The flexible strap means 11 is placed about the workpiece W so that the intermediate portion 14 of the strap means 11 engages the workpiece W and the ends of the strap means 12 and 13 are on opposite sides of the workpiece W to substantially enwrap the workpiece W. In this manner, the present invention may be used with a workpiece of any shape (circular, polygonal or irregular) and the present invention may also be used in locations where access to the workpiece W is limited. The strap means ends 12, 13 are inserted into the front end of the housing 15 in the space formed between the cam means 30 and the sides 18, 19 of the housing 15. The strap means ends 12, 13 are inserted through the housing 15 such that the respective ends of the strap means 12, 13 extend outwardly from the back end of the housing 15 and a flexible loop is formed about the workpiece W with the front end of the housing 15 abutting the workpiece W. With the flexible strap means 11 being drawn tightly about the workpiece W, the cam means 30 is rotated so that the first end 31 and the second end 32 of the cam means 30 engage the strap means 11. The strap means 11 is locked between the respective ends 12, 13 of the cam means 30 and the respective sides 18, 19 of the housing 15. Thus, both ends 31, 32 of the cam means 30 engage the strap means 11 to more securely lock the strap means 11. The means for rotation of the cam means 30 will be discussed below. In this manner, the strap means 11 is securely locked about the workpiece W and further movement of the housing 15 in a rotational direction (as shown by the open arrow in FIGS. 4D, 4F) produces concomitant movement in the workpiece W. Thus, the device of the present invention moves simultaneously with the workpiece W. To remove the strap wrench 10, the cam means 30 is pivoted to release the engagement between the ends 31, 32 of the cam means 30 and the strap means 11; i.e., the cam means 30 is pivoted to a position as shown in FIG. 4B and the strap means 11 may be removed from the housing 15 and from about the workpiece W.

Figure 7:
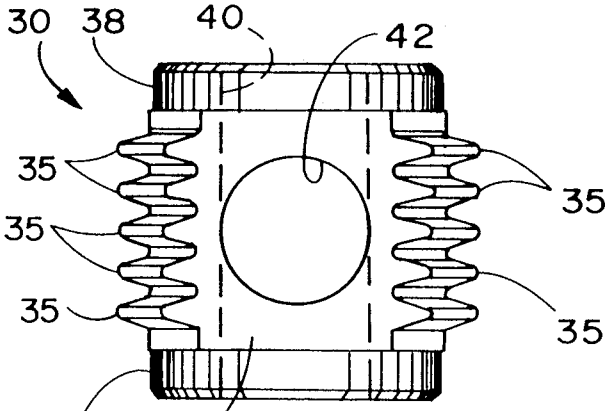
FIG. 7 is an end view of the cam means of the present invention.
Figure 5:
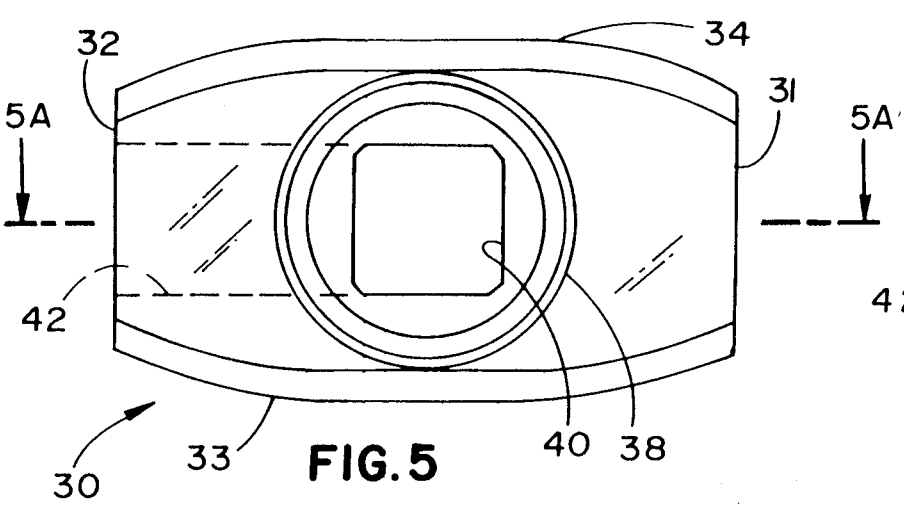
FIG. 5 is a top plan view of the cam means of the present invention.
Figure 6:
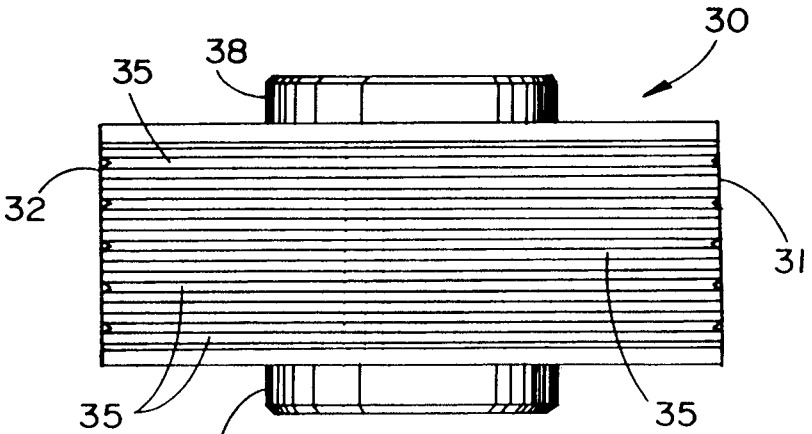
FIG. 6 is a side view of the cam means of the present invention.
Figure 8:
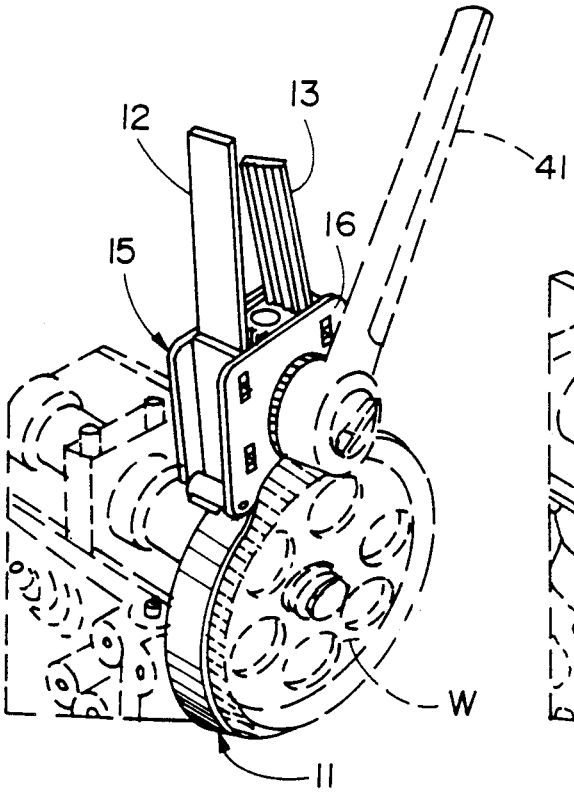
FIG. 8 is a perspective view of the device of the present invention during use thereof on a camshaft timing pulley showing a ratchet wrench received in the opening through the cam means.
Figure 9:
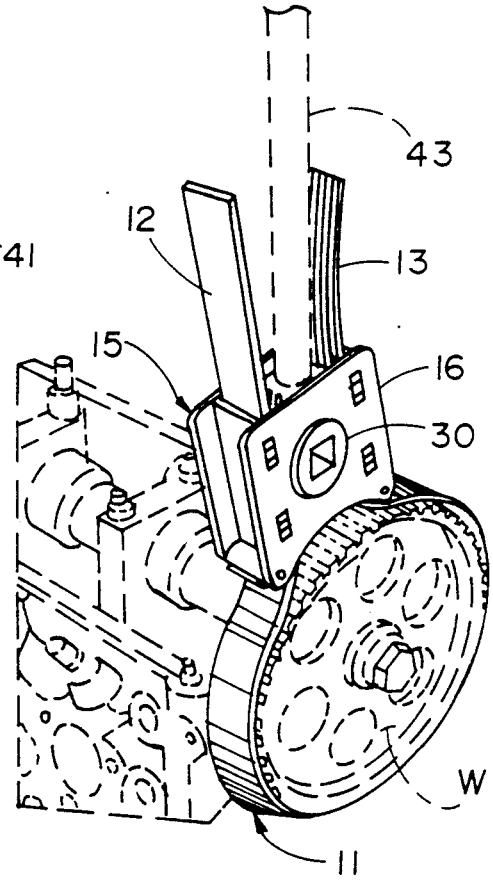
FIG. 9 is a perspective view of the device of the present invention during use thereof on a camshaft timing pulley showing a pry bar received in the bore in the cam means.
Figure 10:
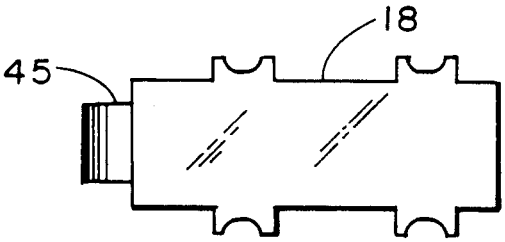
FIG. 10 is a side view of the first side of the housing of the present invention.
Figure 12:
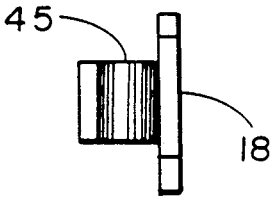
FIG. 12 is an end view of the first side of the housing of the present invention.
Figure 11:
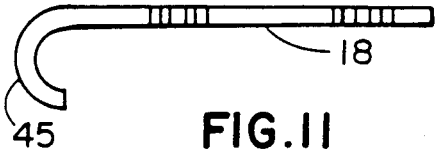
FIG. 11 is a top plan view of the first side of the housing of the present invention.
Figure 13:
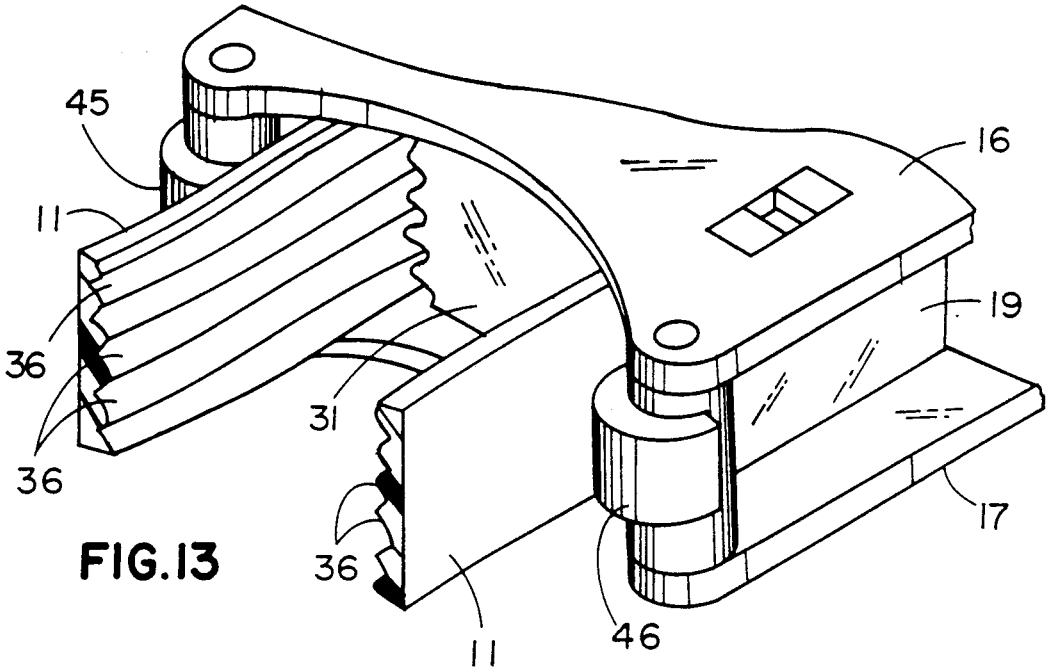
FIG. 13 is an enlarged partial perspective view of the device of the present invention showing the curved end of the side of the housing.

The cam means 30, as shown in FIGS. 5–7 may have an arcuate first side 33 and an arcuate second side 34 to more efficiently engage the strap means 11. Further, the cam means 30 may have a plurality of grooves 35 on the respective sides 33, 34. The grooves 35 may extend from the first end 31 to the second end 32 of the cam means 30. The grooves 35 may cooperate with corresponding grooves 36 which may be provided on the strap means 11. This arrangement of cooperating grooves provides a more effective means of locking the strap means 11 with the cam means 30 and also provides more effective engagement of the strap means 11 with the workpiece W. In this manner, the strap wrench 10 of the present invention may be used with varying types of strap means 11. Preferably, the cam means 30 has a circular boss 38 on the top of the cam means 30 and a circular boss 39 on the bottom of the cam means. The respective circular bosses 38, 39 are received in respective circular openings 22, 23 in the top 16 and bottom 17 of the housing 15. This securely holds the cam means 30 between the top 16 and bottom 17 of the housing 15 and permits pivotal movement of the cam means 30. Further, there is an opening 40 extending through the cam means 30 and the bosses 38, 39 on the cam means. This opening may be square in shape to receive the square drive stud of a ratchet wrench 41 or similar shaped tool. Thus, as shown in FIG. 8, a ratchet wrench 41 may be used conveniently to pivotally move the cam means 30 to engage the strap means 11 within the housing 15 and further to rotate the workpiece. This is especially useful in work spaces where space is limited and access to the workpiece W is difficult. Also, since the opening extends to both sides of the housing 15, the ratchet wrench 41 or other tool may be fitted on either side of the housing 15, greatly facilitating use of the strap wrench 10. The cam means 30 further has a bore 42 extending longitudinally in the cam means 30 from the second end 32 of the cam means 30 toward the first end 31 of the cam means 30 (FIGS. 5, 6). The bore 42 may extend partially into the cam means 30 or completely therethrough. A pry bar 43 or other tool may be inserted in the bore 42 to pivotally move the cam means 30 to engage the strap means 11 as shown in FIG. 9. This feature provides even greater versatility to the strap means 10 of the present invention for those work environments where access is limited.

Figure 14:
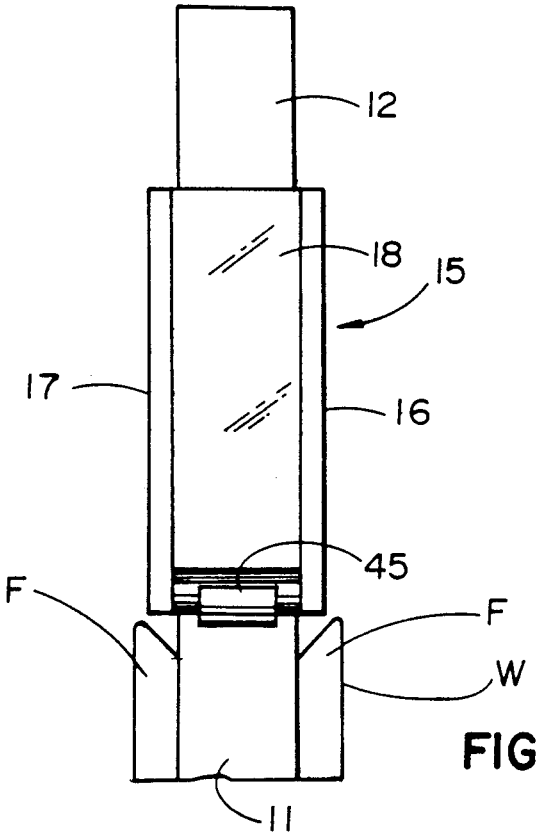
FIG. 14 is a side view of the device of the present invention during use thereof on a pulley having high flanges showing the curved end of the side of the housing disposed between the flanges.

Referring to FIGS. 10–13, the side 18 of the housing 15 is shown with the front end 45 thereof having an arcuate end thereon. The other side 19 of the housing 15 has a similar arcuate front end 46. These ends 45, 46 extend forwardly of the housing 15 and serve several purposes. The ends 45, 46 are the only portions on the front edge of the housing 15 which contact the strap means 11 so that only these curved surfaces engage the strap means 11. There are no sharp ends which can damage the strap means 11. The arcuate ends 45, 46 also facilitate insertion of the strap means ends 12, 13 into the housing 15. This is a most useful feature when working in an environment where access to the workpiece is restricted. Also, the extending curved ends 45, 46 enable the strap wrench 10 to be used with pulleys and other workpieces which have high flanges F thereon as shown in FIG. 14. The extending curved ends 45, 46 are received between the flanges F and engage the strap means 11 securely against the workpiece W so that slippage is reduced.

Accordingly, it will be appreciated that the present invention provides a simple, easy to use strap wrench which facilitates use in all work environments including locations where access to the workpiece is restricted. Means are provided for securing the strap means about the workpiece and easily turning the strap wrench and the workpiece. The strap wrench may be used with a tool such as a ratchet wrench or pry bar for ease of tightening and rotation of the workpiece.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A strap wrench for engaging a workpiece, the strap wrench comprising: a flexible strap means having a first end, a second end, and an intermediate portion therebetween; a housing having a first opening and a second opening therein through which the respective first and second ends of the flexible strap means may be removably inserted such that a flexible loop is formed in the intermediate portion of the flexible strap means, said loop being formed securely about the workpiece; the housing further having a first side, a second side, a top having an opening therein, a bottom having an opening therein, the openings in the top and bottom being substantially aligned with one another; a cam means movably disposed within the housing such that the first opening in the housing is formed between the cam means and the first side of the housing and the second opening in the housing is formed between the cam means and the second side of the housing, the cam means further having an opening therethrough communicating with the openings in the top and bottom of the housing such that a tool means may be inserted in the opening to adjust the cam means thereby locking the strap means between said cam means and the side of the housing to prevent movement of the strap means therebetween, such that rotation of the tool means produces concomitant rotation of the workpiece.

2. A strap wrench for engaging a workpiece, the strap wrench comprising: a housing having a first side and a second side; a cam means pivotally mounted in the housing such that the cam may approach the first side and the second side of the housing; a flexible strap means having a first side, a second side and an intermediate portion therebetween; the sides of the strap means being received in the housing such that the cam means may be pivoted to engage the first side of the strap means and lock said side of the strap means against the first side of the housing and the cam means may be pivoted to engage the second side of the strap means against the second side of the housing thereby forming a loop in the intermediate portion of the strap means such that the loop securely engages the workpiece; means for connecting a wrenching means to the cam means such that the cam means may be pivoted to engage the strap means, thereby securing the strap means within housing and about the workpiece and such that further movement of the wrenching means produces movement of the strap wrench and of the workpiece.

3. The strap wrench of claim 2, wherein the wrenching means is a ratchet wrench.

4. The strap wrench of claim 2, wherein the wrenching means is a pry bar.

5. A strap wrench for engaging a workpiece, the strap wrench comprising a housing having a top, a bottom, a first side, a second opposing side, a front end and a back end; a cam means mounted within the housing, the cam means having a first end, a second end and a center portion, the cam means being disposed in the housing between the top of the housing and the bottom of the housing such that the first end of the cam means is oriented toward the front end of the housing and the second end of the cam means is oriented toward the back end of the housing, the center portion of the cam means being attached to the housing for pivotal movement therein such that the first end and the second end of the cam means are spaced apart from the respective sides of the housing and when the cam means is pivotally moved, the ends of the cam means approach the respective sides of the housing; a flexible strap means having a first end, a second end and an intermediate portion therebetween; the first end of the strap means being removably disposed through the housing in the space between the cam means and the first side of the housing and the second end of the strap means being removably disposed in the housing in the space between the cam means and the second side of the housing such that the respective ends of the strap means extend outwardly from the back end of the housing and a flexible loop is formed in the intermediate portion of the flexible strap means, the loop extending outwardly from the front end of the housing, said loop being formed and secured about the workpiece; means for pivotally moving the cam means within the housing such that the first end of the cam means and the second end of the cam means may engage the strap means between the respective ends of the cam means and the respective sides of the housing, locking the strap means therebetween to prevent movement of the strap means and such that when the strap means is so locked, further movement of the housing in a rotational direction produces concomitant movement in the workpiece about which the strap means is looped.

6. The strap wrench of claim 5, wherein the cam means has a pair of sides, each side having thereon a plurality of grooves such that the cam may more effectively lock the strap means.

7. The strap wrench of claim 6, wherein the strap means has plurality of grooves thereon, the grooves cooperating with the grooves on the cam means.

8. The strap wrench of claim 6, wherein the sides of the cam means are arcuate.

9. The strap wrench of claim 5, further comprising the top of the housing having an opening therein, the bottom of the housing having an opening therein, the openings in the top and the bottom of the housing being substantially aligned with one another; the cam means having an opening therethrough, said opening communicating with the openings in the top and in the bottom of the housing such that means for pivotally moving the cam means may be received in the opening in the cam means on the top of the housing and on the bottom of the housing as desired.

10. The strap wrench of claim 9, further comprising the openings in the top and the bottom of the housing being circular openings; the cam means having a top and a bottom; a circular boss extending outwardly from each the top and the bottom of the cam means; the circular boss on the top of the cam means being received in the circular opening in the top of the housing, the circular boss on the bottom of the cam means being received in the circular opening in the bottom of the housing such that the cam means is securely attached to the top and the bottom of the housing and may pivotally move therebetween.

11. The strap wrench of claim 9, wherein the means for pivotally moving the cam means within the housing comprises a ratchet wrench received in the opening through the cam means.

12. The strap wrench of claim 5, further comprising the cam means having a bore therein, the bore extending longitudinally from the second end toward the first end of the cam means such that a tool may be inserted into said bore and the tool may produce pivotal movement of the cam means.

13. The strap wrench of claim 12, wherein the means for pivotally moving the cam means within the housing comprises a pry bar received in the bore in the cam means.

14. The strap wrench of claim 5, further comprising the front of the first side and the front of the second side each having an arcuate end thereon, the arcuate end extending outwardly from the respective side such that said arcuate ends may be received on workpieces having flanged surfaces extending outwardly therefrom.

15. The method of moving a workpiece with a strap wrench which comprises the steps of: providing a housing having a first side, a second side, a front and a back; providing a cam means pivotally mounted within the housing, the cam means having a first end oriented toward the front of the housing and a second end oriented toward the back of the housing such that the ends of the cam means are spaced apart from the respective sides of the housing thereby forming a first opening between the cam means and the first side of the housing and forming a second opening between the cam means and the second side of the housing; providing a flexible strap means having a first end, a second end and an intermediate portion therebetween; inserting the first end of the strap means through the first opening such that the first end of the strap means extends outwardly from the back of the housing; disposing the intermediate portion of the strap means about the workpiece; inserting the second end of the strap means through the second opening such that the second end of the strap means extends outwardly from the back of the housing; pulling the ends of the strap means to secure the intermediate portion of the strap means about the workpiece; pivotally moving the cam means in a desired direction such that the ends of the cam means engage the strap means and lock the strap means between the cam means and the respective sides of the housing, thereby locking the strap means about the workpiece; and moving the strap wrench in the desired direction and thereby moving the workpiece in the desired direction.

* * * * *